US009446597B2

(12) United States Patent
Kusuda

(10) Patent No.: US 9,446,597 B2
(45) Date of Patent: Sep. 20, 2016

(54) LIQUID EJECTION APPARATUS

(71) Applicant: Miyuki Kusuda, Nagoya (JP)

(72) Inventor: Miyuki Kusuda, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/189,566

(22) Filed: Feb. 25, 2014

(65) Prior Publication Data

US 2014/0240407 A1 Aug. 28, 2014

(30) Foreign Application Priority Data

Feb. 28, 2013 (JP) ..... 2013-039788

(51) Int. Cl.
*B41J 2/175* (2006.01)
*B41J 19/20* (2006.01)

(52) U.S. Cl.
CPC ..... *B41J 2/17523* (2013.01); *B41J 19/20* (2013.01)

(58) Field of Classification Search
CPC ..... B41J 2/17523
See application file for complete search history.

(56) References Cited

U.S. PATENT DOCUMENTS

| | | | | |
|---|---|---|---|---|
| 6,493,937 | B1 | 12/2002 | Axtell et al. | |
| 2003/0107624 | A1* | 6/2003 | Koga | B41J 2/175 347/85 |
| 2013/0063531 | A1* | 3/2013 | Muraki | B41J 19/20 347/85 |

FOREIGN PATENT DOCUMENTS

| | | | |
|---|---|---|---|
| JP | 2002-506759 | A | 4/2004 |
| JP | 2007-144776 | A | 6/2007 |
| JP | 2008-41798 | A | 2/2008 |
| JP | 2008-44132 | A | 2/2008 |
| JP | 2012-871 | A | 1/2012 |

* cited by examiner

*Primary Examiner* — Manish S Shah
*Assistant Examiner* — Jeffrey C Morgan
(74) *Attorney, Agent, or Firm* — Merchant & Gould P.C.

(57) ABSTRACT

A liquid ejection apparatus comprising a carriage, a liquid ejection head mounted on the carriage, at least one tube member operably connected to the liquid ejection head, a holding wire for securing the tube member, and a structural member, and a cover plate positioned between the structural member and the holding wire.

18 Claims, 8 Drawing Sheets

LIQUID EJECTION APPARATUS

CROSS-REFERENCE TO RELATED APPLICATIONS

This application claims priority from Japanese Patent Application No. 2013-039788 filed on Feb. 28, 2013, which is incorporated herein by reference in its entirety.

TECHNICAL FIELD

The present disclosure relate to a liquid ejection apparatus that ejects liquid. In particular, the present disclosure is directed to a liquid ejection apparatus having a holding wire for holding flexible tube members that carry liquid.

BACKGROUND

Japanese Unexamined Patent Application Publication No. 2012-871 describes a liquid ejection apparatus such as an inkjet printer that ejects ink to make a printout. In the printer described therein, an inkjet head is mounted in a carriage that bidirectionally moves in a scanning direction. As discussed herein, a scanning direction refers to a position parallel to a horizontal plane. The inkjet head is connected to ink cartridges positioned in the printer body through tubes. A tube holding wire is additionally provided in the printer body. A frame is additionally disposed above a tube holding wire, and a control circuit board may be mounted on the frame. The tube holding wire extends upwardly beyond other portions of the printer and is swingable around an axis that extends vertically and prevents the tubes from hanging downwardly. As the carriage moves in the horizontal, scanning direction, the holding wire simultaneously swings, thereby moving the tubes, causing ink transfer from the cartridges, through the tubes, to the inkjet head positioned on the carriage. In some embodiments, as the tubes move, part of the tubes and the tube holding wire may catch an edge of a structural member, such as the printer frame on which the control circuit board is mounted. This may cause damage to the circuit board and/or other parts of the printer.

SUMMARY

According to example aspects of the present disclosure, a liquid ejection apparatus configured to perform printing on a medium is disclosed. The example embodiments discussed herein and can be implemented as described below.

According to one or more aspects of the disclosure, an object of the present invention is to provide a liquid ejection apparatus comprising a carriage configured to reciprocate in a scanning direction; a liquid ejection head mounted in the carriage; a flexible member connected to the liquid ejection head; and a hold member configured to hold the flexible member. Additionally provided is a structural member arranged along a virtual plane, the virtual plane parallel to a virtual line extending in the scanning direction, the structural member including an edge portion; wherein one of the hold member and the flexible member comprises a proximal portion nearest to the structural member in a direction perpendicular to the virtual plane; and the proximal portion is movable between first and second positions as the carriage reciprocates in the scanning direction, wherein in the first position, the structural member overlaps the proximal portion in a direction perpendicular to the virtual plane and in the second position the structural member does not overlap the proximal portion in the direction perpendicular to the virtual plane. Further provided is a cover plate provided between the structural member and the proximal portion, wherein at least a portion of the cover plate overlaps the edge portion in the direction perpendicular to the virtual plane, and wherein the cover plate overlaps the proximal portion in the direction perpendicular to the virtual plane in the first and second positions.

According to one or more aspects of the disclosure, a liquid ejection apparatus comprising a carriage configured to reciprocate in a movement range, the movement range extending along a first direction parallel to a virtual plane; a liquid ejection head mounted in the carriage; a flexible member connected to the liquid ejection head; and a hold member configured to hold the flexible member. Additionally provided is a structural member arranged along the virtual plane; wherein one of the hold member and the flexible member comprises a proximal portion nearest to the structural member in a direction perpendicular to the virtual plane, the proximal portion is configured to move in a movement region as the carriage reciprocates in the movement range, the movement region is part of the movement range. Additionally, the structural member comprises a body and a cover portion, the cover portion protruding in a direction parallel to a line intersecting the first direction; and wherein the body is arranged to overlap a first part of the movement region in the direction perpendicular to the virtual plane, and the cover is arranged to overlap a second part of the movement region in the direction perpendicular to the virtual plane.

According to one or more aspects of the disclosure, a printer is disclosed, the printer comprising a cartridge holding a liquid; and a liquid ejection apparatus, the liquid ejection apparatus including: a carriage configured to reciprocate in a scanning direction; a liquid ejection head mounted in the carriage for fluid connection to the cartridge; and a flexible member connected to the liquid ejection head. Additionally, the liquid ejection apparatus includes a hold member configured to hold the flexible member; a structural member arranged along a virtual plane, the virtual plane parallel to a virtual line extending in the scanning direction, the structural member including an edge portion; wherein one of the hold member and the flexible member comprises a proximal portion nearest to the structural member in a direction perpendicular to the virtual plane. Further, the proximal portion is movable between first and second positions as the carriage reciprocates in the scanning direction, wherein in the first position, the structural member overlaps the proximal portion in a direction perpendicular to the virtual plane and in the second position the structural member does not overlap the proximal portion in the direction perpendicular to the virtual plane; and a cover plate provided between the structural member and the proximal portion, wherein at least a portion of the cover plate overlaps the edge portion in the direction perpendicular to the virtual plane, and wherein the cover plate overlaps the proximal portion in the direction perpendicular to the virtual plane in the first and second positions.

DETAILED DESCRIPTION

Figure 1:
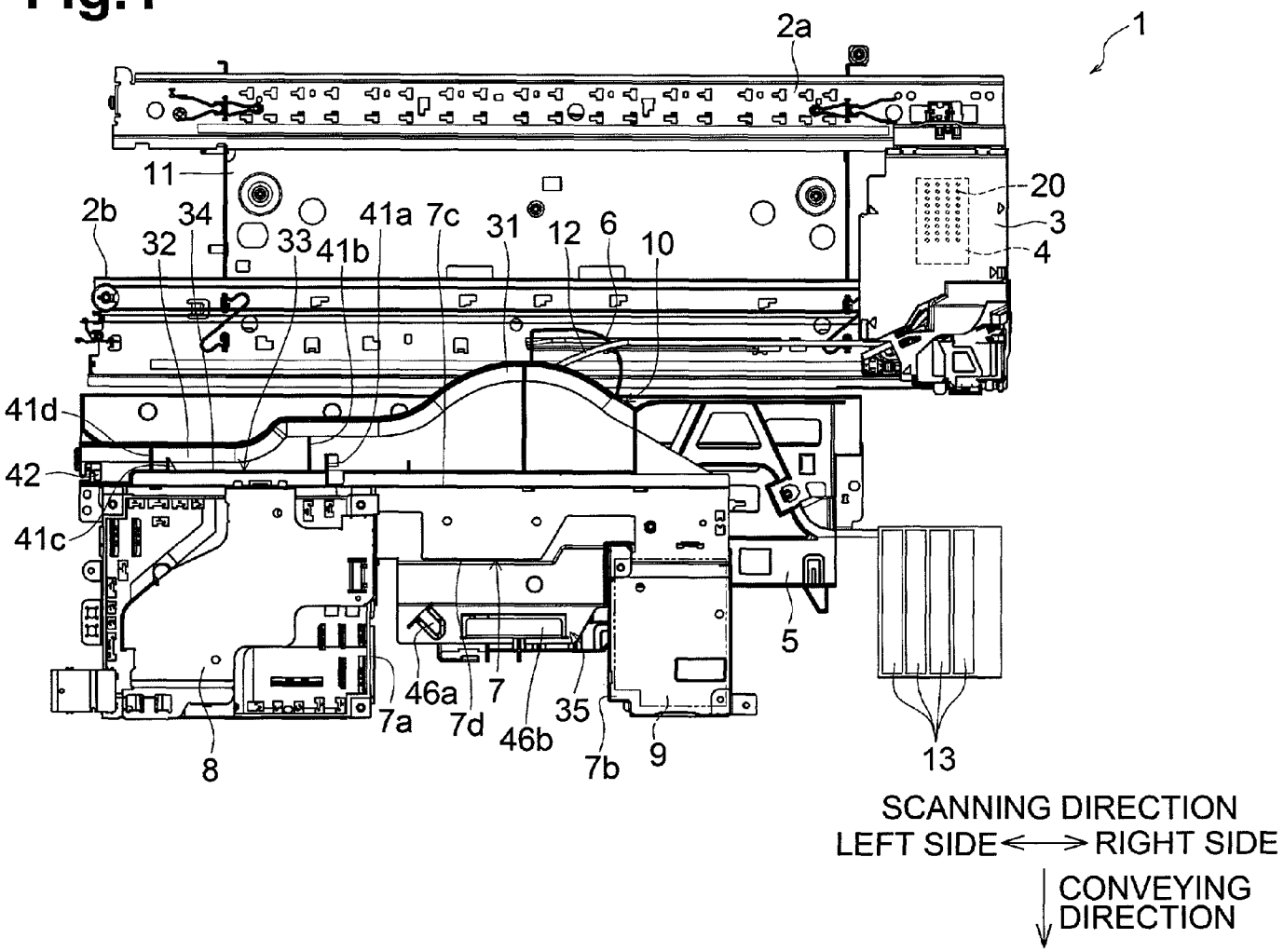
FIG. 1 schematically illustrates the structure of a printer in an embodiment of the present invention.

Various embodiments will be described in detail with reference to the drawings, wherein like reference numerals represent like parts and assemblies throughout the several views. Reference to various embodiments does not limit the scope of the claims attached hereto. Additionally, any example set forth in the specification are not intended to be limiting and merely set forth some of the many possible embodiments for the appended claims.

Within this patent document, the conjunction "or" connotes "and/or" inappropriate. The indefinite articles "a" and "an" connotes "one or more" unless stated otherwise or where the use of "one or more" is clearly inappropriate. Additionally, qualifiers such as "about" and "substantially" connotes physical structures, physical relationships, and values for given measurements, parameters, ranges, and the like, can vary due to differences in manufacturing tolerances and conditions of use.

In general, the present disclosure describes systems and methods for preventing tube members of the disclosed printer assembly from catching an edge of a structural member, thereby preventing damage to components positioned proximal to the tube members. As illustrated in FIGS. 1 to 4, a printer 1, such as a liquid ejection apparatus has two guide rails 2*a* and 2*b*, a carriage 3, a liquid ejection head 4 (hereinafter referred to as "inkjet head 4"), a main body frame 5, a holding member 6, a circuit board frame 7 (hereinafter referred to as "structural member 7"), a control circuit board 8, a circuit board 9, and a cover plate 10. In FIGS. 2 and 3, to simplify positional relationships among constituent components, the contour lines of the structural member 7, control circuit board 8, circuit board 9, and cover plate 10 are indicated by bold lines. In FIG. 3, to simplify the drawing, the contour lines of the main body frame 5 are omitted. In FIG. 3, for reference purposes, the positions of the contour lines of the structural member 7 are indicated by dash-dot lines and the positions of the contour lines of the cover plate 10 are indicated by dash-dot-dot lines.

Figure 2:
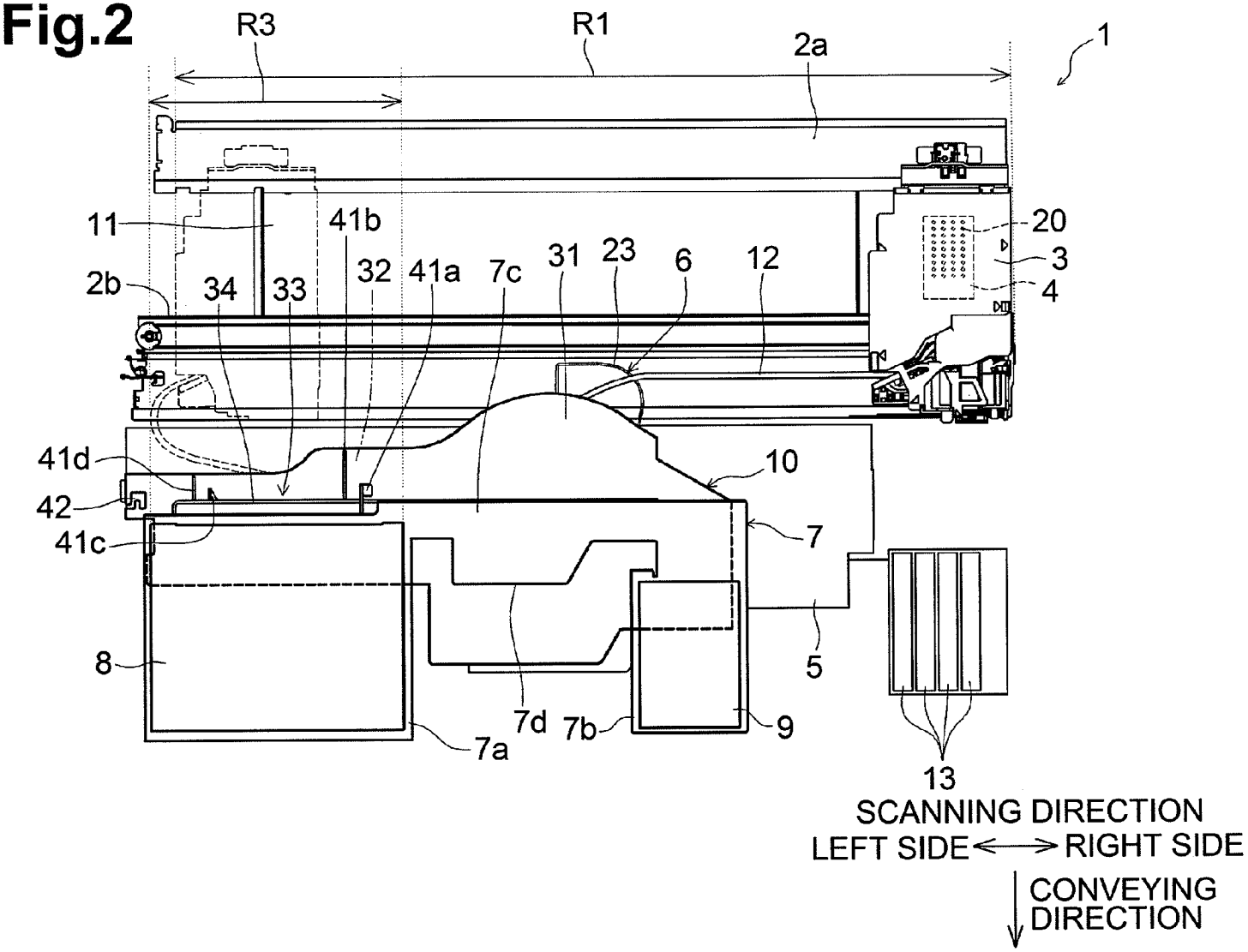
FIG. 2 illustrates an example embodiment of components of the printer structure of FIG. 1.
Figure 3:
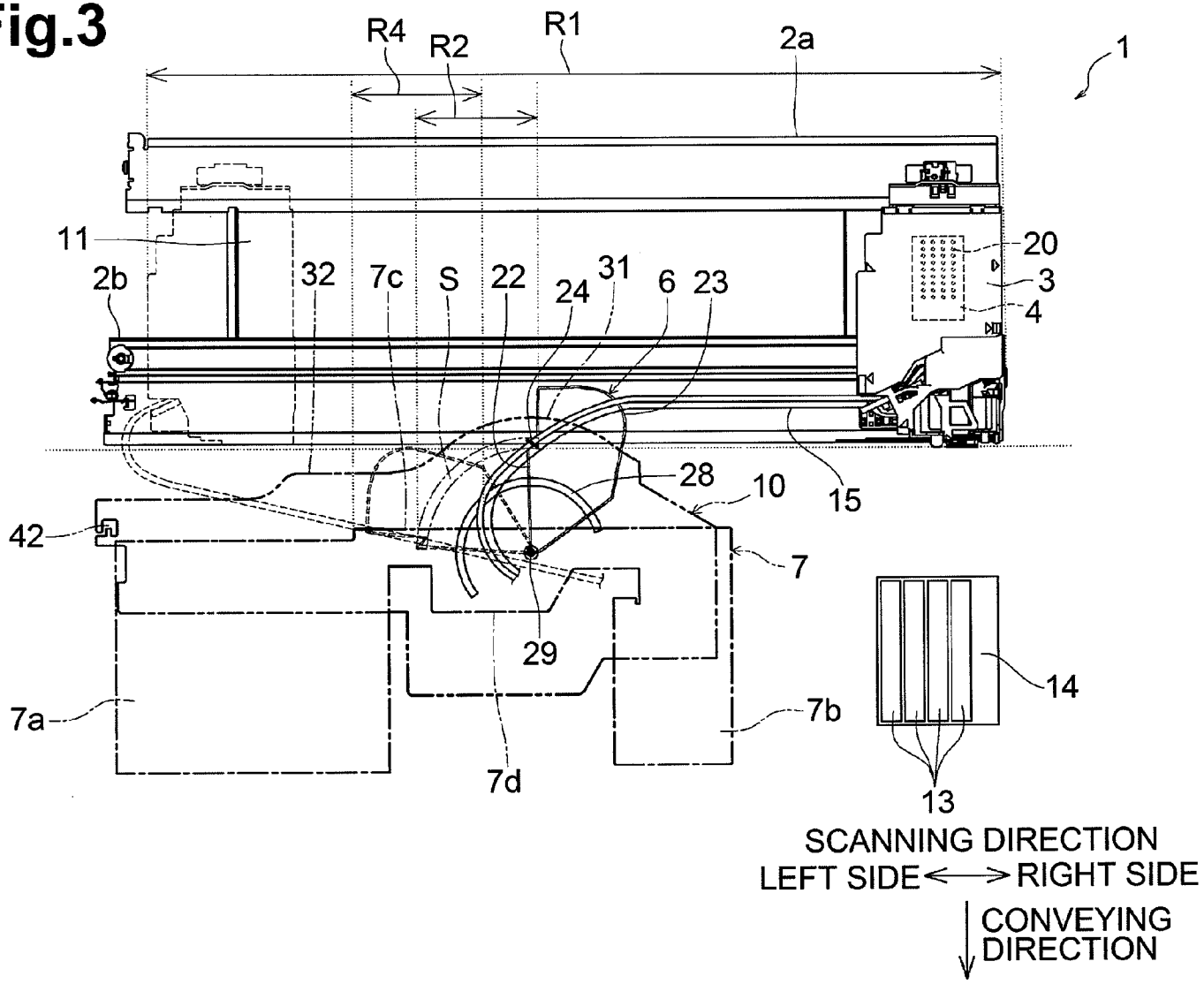
FIG. 3 illustrates an example embodiment of the printer structure of FIG. 1 excluding a circuit board frame and cover plate.

As shown in FIGS. 1-3, the two guide rails 2*a* and 2*b* extend in a prescribed scanning direction parallel to a horizontal plane (i.e., a virtual plane) and are positioned so as to be spaced apart from each other in a conveying direction. As described herein, a conveying direction refers to a position orthogonal to the horizontal scanning direction. The guide rails 2*a* and 2*b* are supported by a support frame 11 disposed below them. The end of the carriage 3 on the upstream side in the conveying direction is supported by the guide rail 2*a* from below, and the end of the carriage 3 on the downstream side is supported by the guide rail 2*b* from below. The carriage 3 bidirectionally moves in the scanning direction along the guide rails 2*a* and 2*b* within a movement range R1. The descriptions below assume that the right side and left side of the scanning direction are defined as illustrated in FIG. 1.

The inkjet head 4 is mounted in the carriage 3. The inkjet head 4 has a plurality of nozzles 20, from which ink is ejected through its lower surface (not shown). Four tubes 12 (also referred to as a generic "flexible member" wherein a flexible member includes a broader category of components, such as a flexible substrate or a tube for transferring ink.) are operably connected to the inkjet head 4. The four tubes 12, which are vertically positioned, are connected to the four ink cartridges 13 via a cartridge mount portion 14 provided in the main body of the printer 1. The cartridge mount portion 14 is detachable from the four ink cartridges 13. The four ink cartridges 13 store ink of varying colors, such as, black, yellow, cyan, and magenta. In some embodiments, the ink cartridges 13 store ink on the right side of the scanning direction. Alternatively, the four ink cartridges 13 store ink on the left side in the scanning direction. The ink stored in the four ink cartridges 13 are supplied to the inkjet head 4 through the four tubes 12. Alternatively, in other embodiments, the ink cartridges 13 may be positioned in the carriage 3 and hence tubes 12 are not required for ink transfer. The inkjet head 4 ejects the ink in these four colors from the plurality of nozzles 20 and onto recording paper positioned below make a printout on recording paper, the printer 1 ejects ink from the inkjet head 4, which moves bidirectionally in the scanning direction with the carriage 3 while causing a conveying mechanism (not illustrated) to displace the recording paper in the conveying direction.

Main Body Frame and Holding Wire

As shown in FIG. 2, the main body frame 5, which is made of a synthetic resin, is disposed downstream to the guide rail 2*b* in the conveying direction. The holding wire 6 is operably connected to the upper surface of the main body frame 5.

Figure 5A:
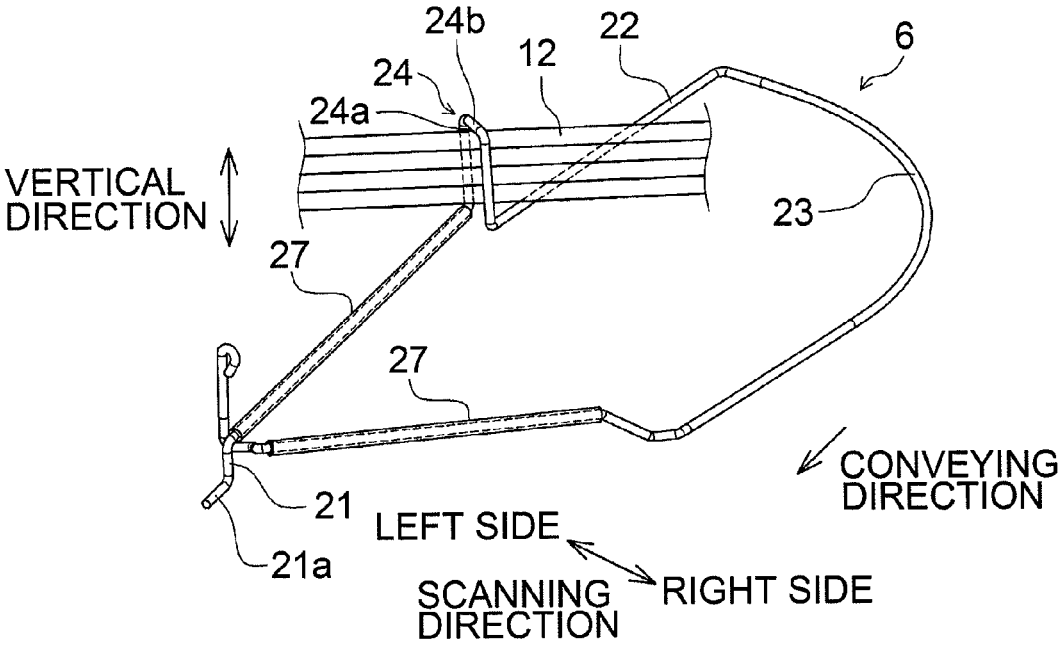
FIG. 5A is a perspective view of a holding wire and tubes.
Figure 5B:
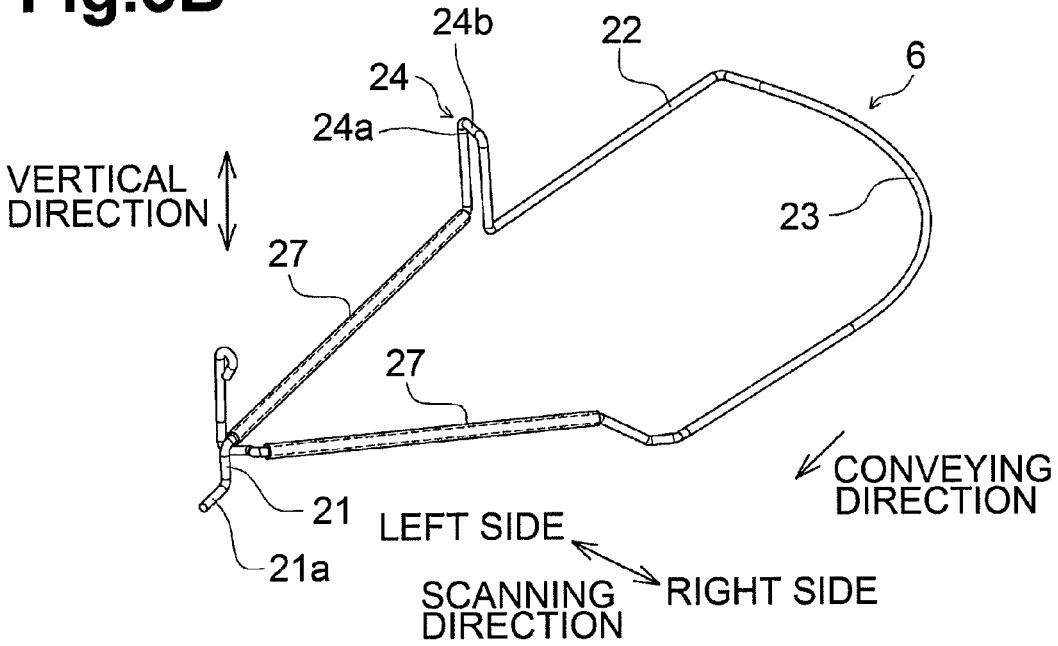
FIG. 5B is a perspective view of a holding wire, as shown in FIG. 5A.

FIGS. 5A and 5B illustrate a perspective view of the holding wire 6, which is used for securing the four tubes 12 as they move bidirectionally in the scanning direction. The holding wire 6 supports the four tubes 12 to prevent them from hanging downward.

The holding wire 6 has a swinging axis 21, a straight part 22, and curved part 23. In some embodiments, the holding wire 6 is made of a metal material. As illustrated, the holding wire 6 is made of a plurality of connected sections including a swinging axis 21, a drop-preventing part 21*a*, a straight part 22, a curved part 23, a tube holding part 24, and protective tubes 27.

The swinging axis 21 extends in a vertical direction perpendicular to the scanning direction and passes through a through-hole 29 (shown in FIG. 3) formed in the upper surface of the main body frame 5. Thus, the holding wire 6 is swingably supported by the main body frame 5 at the swinging axis 21. The drop preventing part 21*a*, which is formed at about a 90 degree angle from the lower end of the swinging axis 21, passes through the through-hole 29 and is caught by a wall of the through-hole 29 formed in the main body frame 5, preventing the holding wire 6 from coming away from the main body frame 5.

The straight part 22, is connected to, and extends in an angled direction linearly from the upper end 24*b* of the swinging axis 21." The tube holding part 24 is formed at an intermediate point on the straight part 22. In some embodiments, the tube holding part 24 is formed by bending the straight part 22 four times at about 90 degree angles. In other embodiments, the tube holding part 24 is a separate piece connected between the straight part 22 and a protective tube 27. The tube holding part 24 upwardly extends beyond the other portions of the straight part 22. As shown in FIGS. 5A and 5B, the tube holding part 24 forms a clearance 24*a*, which extends vertically above the straight part 22. Accordingly, the four tubes 12 are passed through the clearance 24*a*.

The curved part 23 is linked to an end, of the straight part 22. The curved part 23 is curved so as to be convex in a direction away from the straight part 22 (so as to be convex toward the right side in the scanning direction in the state illustrated in FIG. 1). The portion 23*a* of the curved part 23 close to the swinging axis 21 and opposite to the straight part 22 is positioned below the straight part 22 and is connected to an upwardly bent portion. Thus, the portion 23*a* is operably attached to the straight part 22 in the vicinity of the swinging axis 21.

Accordingly, the supporting wire 6 supports the four tubes 12 passing through the clearance 24*a*, preventing the four tubes 12 from hanging downward. When the tubes 12 move together with the carriage 3, the holding wire 6 also swings around the swinging axis 21 corresponding to the movement of the tubes 12.

Referring now to FIGS. 2 and 3, the carriage 3 moves along the guide rails 2*a* and 2*b* in a horizontal scanning direction along range R1. The carriage 3 is depicted in a start position at the right end of range R1, as indicated by a solid line. The carriage 3 is also depicted in an end position at the left end of range R1, as indicated by a dashed line. Furthermore, the positions of the four tubes 12 and the holding wire 6, when the carriage 3 is positioned at the right end of the movement range R1, are indicated by solid lines, and the positions of the four tubes 12 and the holding wire 6, when the carriage 3 is positioned at the left end of the movement range R1, are indicated by broken lines.

As shown in FIG. 3, when the carriage 3 moves in the scanning direction, the holding wire 6 swings around the swinging axis 21 between its position indicated by the solid lines and its position indicated by the broken lines. As the carriage 3 moves in the scanning direction and the holding wire 6 swings around the swinging axis 21, the tube holding part 24 moves within the movement area S. The movement range R2 within which the tube holding part 24 moves in the movement area S in the scanning direction is part of the movement range R1 of the carriage 3.

A protrusion 28, which upwardly protrudes is formed on the upper surface of the main body frame 5. The arc-shaped protrusion 28 extends through an area over which portions of the straight part 22 and curved part 23 pass. Each point of the arc-shaped protrusion 28 is approximately equidistant to the swinging axis 21. Thus, the holding wire 6 is supported by the protrusion 28 on the main body frame 5 from below. The protective tubes 27, which are made of a synthetic resin or other suitable material(s), are attached to the straight part 22 and curved part 23 of the holding wire 6 at the locations where the protrusion 28 comes into contact with the holding wire 6. Accordingly, the protective tubes 27 prevent the metal material of the holding wire 6 and the protrusion 28, which in some embodiments is made of a synthetic resin, from coming into direct contact with each other.

Circuit Board Frame and Control Circuit Board

Now referring to FIGS. 1-3, the circuit board frame 7 is positioned above the main body frame 5 so as to overlap the main body frame 5. In some embodiments, the circuit board frame 7 is made of a metal material, however other suitable materials may alternatively be used. In the embodiment shown, the circuit board frame 7 extends along a placement plane parallel to a virtual plane extending in the scanning direction and the conveying direction. The circuit board frame 7 extends beyond an area left of the guide rail 2*b* and extends beyond an area right of the holding wire 6. Both ends of the circuit board frame 7 in the scanning direction extend in the conveying direction beyond a portion between these ends; both ends of the circuit board frame 7 in the conveying direction are referred to as circuit board mounting parts 7*a* and 7*b*. A control circuit board 8 is mounted on the upper surface of the circuit board mounting part 7*a*, and a communication circuit board 9 is mounted on the upper surface of the circuit board mounting part 7*b*. The control circuit board 8, which controls the operation of the printer 1, extends in the scanning direction across a range R3. The control circuit board 8 is electrically connected to the inkjet head 4 via a flexible member 15 (hereinafter referred to as "FFC"). The FFC 15 is used to transmit electricity and signals to the inkjet head 4. In some embodiments, the circuit board 9 is a circuit board different from the control circuit board 8; the circuit board 9 is, for example, a circuit board for communication.

An edge 7*c* (hereinafter may be referred to as an "edge portion") of the circuit board frame 7 on the upstream end in the conveying direction extends in the scanning direction. The edge 7*c* of the circuit board frame 7 is located in the conveying direction between the position of the tube holding part 24 in the state in which the holding wire 6 is positioned as indicated by the solid lines in FIG. 3 and the position of the tube holding part 24 in the state in which the holding wire 6 is positioned as indicated by the broken lines. Accordingly, the movement area S of the tube holding part 24 extends, in plan view, across an area that overlaps the circuit board frame 7 and an area that does not overlap the circuit board frame 7. That is, the tube holding part 24 crosses, in plan view, the edge 7*c* and moves between the area that overlaps the circuit board frame 7 and the area that does not overlap the circuit board frame 7. The tubes 12 extend so as to cross, in plan view, the edge 7*c* of the circuit board frame 7. When the carriage 3 moves within the movement range R1, a portion on the tubes 12 that crosses the edge 7*c* moves within the range R4 in the scanning direction.

Cover Plate

Figure 4:
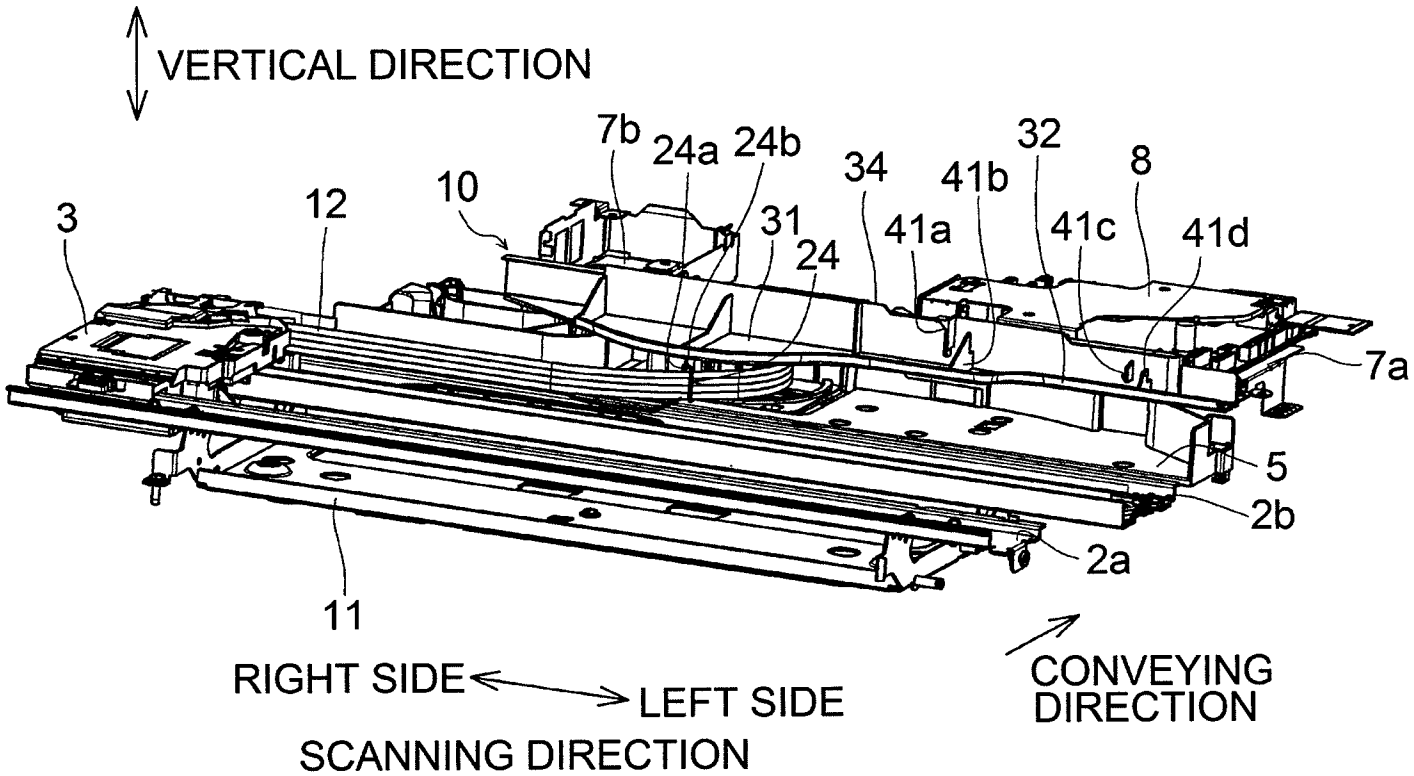
FIG. 4 is perspective view of the printer illustrated in FIG. 1.

As shown in FIGS. 1-3, the cover plate 10, which is made of a synthetic resin or other suitable material(s), is placed on the lower surface of the circuit board frame 7. That is, the cover plate 10 is placed between the circuit board frame 7 and the holding wire 6. The cover plate 10 extends in the scanning direction substantially within the same range as the circuit board frame 7. In the entire area in the scanning direction, the upstream end of the cover plate 10 in the conveying direction extends toward the upstream side in the conveying direction beyond the edge 7*c* of the circuit board frame 7. At the upstream end of the cover plate 10 in the conveying direction, a portion positioned in a partial range including the movement range R2 of the tube holding part 24 in the scanning direction is referred to as an extruding part 31, which protrudes toward the upstream side in the conveying direction beyond other portions positioned in other ranges. The extruding part 31 protrudes to the upstream side in the conveying direction beyond the movement area S of the tube holding part 24. Thus, the cover plate 10 covers the entire movement area S of the tube holding part 24. Accordingly, the lower surface of the cover plate 10 faces the tube holding part 24 and the upper surface of the cover plate 10 faces the circuit board frame 7. The lower surface of the cover plate 10 at the upstream end in the conveying direction is disposed above an upper end 24*b* (hereinafter referred to as a "proximal portion") of the tube holding part 24, as illustrated in FIG. 4.

The extruding part 31 protrudes toward the upstream side in the conveying direction beyond the downstream end of the carriage 3 in the conveying direction. When the carriage 3 passes the movement range R2 of the tube holding part 24, the downstream end of the carriage 3 in the conveying direction passes below the extruding part 31.

At the upstream end of the cover plate 10 in the conveying direction, a portion positioned in range R3 in the scanning direction, in which the control circuit board 8 is placed is referred to as a circuit board protection part 32. The circuit board protection part 32 extrudes toward the upstream side in the conveying direction beyond the edge 7*c* of the circuit board frame 7, but is positioned on the downstream side in the conveying direction relative to the downstream end of the carriage 3 in the conveying direction. As is shown in FIG. 2, the range R3 includes the left end of the movement range R1 of the carriage 3.

Figure 6:
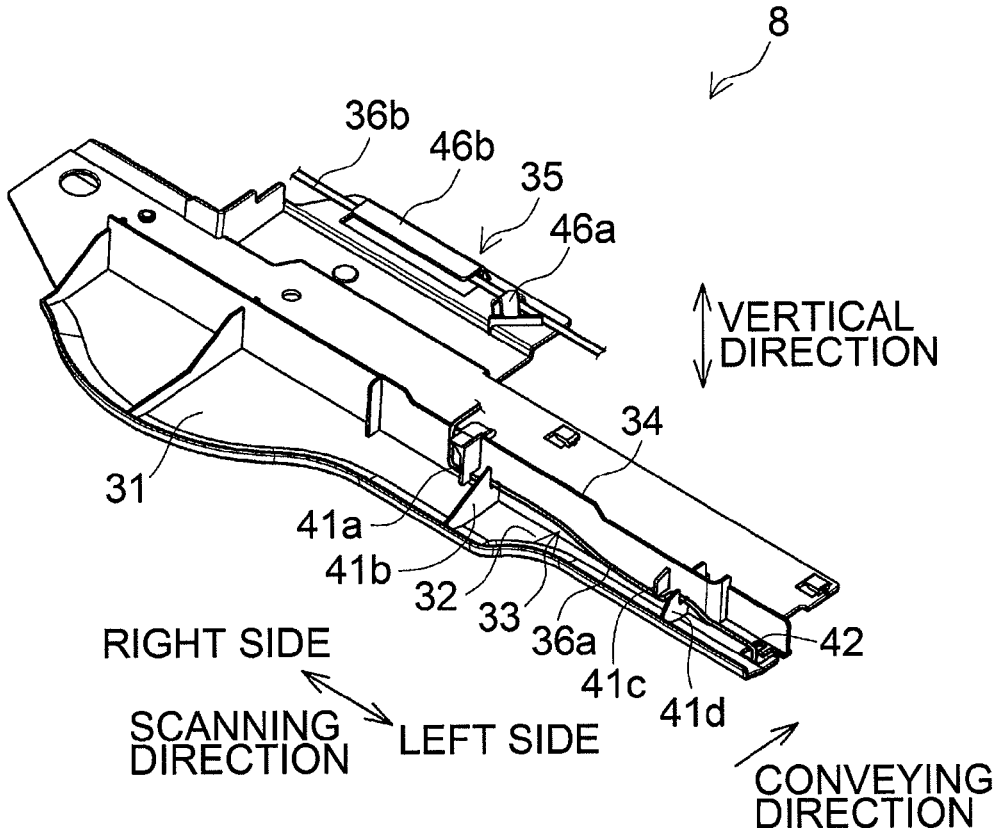
FIG. 6 is a perspective view of the cover plate.

As shown in FIGS. 2 and 6, a wire holding part 33, which holds a wire 36*a* drawn from the control circuit board 8, is provided in the cover plate 10 at a position in a range that includes the range R3, in which the control circuit board 8 is placed. The wire holding part 33 has four wire hooking parts 41*a* to 41*d* and an insertion part 42. A wall 34, which upwardly protrudes and extends in the scanning direction, is formed on a portion of the upper surface of the cover plate 10, excluding the right end of the cover plate 10 in the scanning direction. The four wire hooking parts 41*a* to 41*d* are positioned at intervals in the scanning direction on a surface of the wall 34 on the upstream side in the conveying direction, wherein the surface is positioned in the range R3 in which the control circuit board 8 is placed. The insertion part 42 is formed at the left end of the cover plate 10 in the scanning direction and at a position on the upstream side in the conveying direction relative to the wall 34; the insertion part 42 vertically passes the cover plate 10.

The wire 36*a* drawn from the control circuit board 8 extends toward the insertion part 42 in the scanning direction, as illustrated in FIG. 6. The portion of the wire 36*a* that extends in the scanning direction is hooked to the wall 34 by the wire hooking parts 41*a* to 41*d*. The wire 36*a* thereafter passes through the insertion part 42 and extends downwardly beyond the cover plate 10. The wire 36*a* is, for example, a wire connected to a sensor attached to the printer 1 or a wire connected to a motor that drives a transfer mechanism (not illustrated). Although only one wire 36*a* is held to the wire holding part 33, a plurality of wires 36*a* may additionally be held to the wire holding part 33.

Referring now to FIGS. 1, 2, and 6, a wire holding part 35 is provided on the upper surface of the cover plate 10 at a position between the circuit board mounting part 7*a* and the circuit board mounting part 7*b* in the scanning direction. The wire holding part 35 holds an FFC 36*b*, which connects the control circuit board 8 and circuit board 9. The wire holding part 35 has two wire hooking parts 46*a* and 46*b*, which are positioned on the cover plate 10 in the scanning direction. The FFC 36*b*, which extends in the scanning direction and connects the control circuit board 8 and circuit board 9, is attached to the cover plate 10 by the two hooking parts 46*a* and 46*b*, as illustrated in FIG. 6.

With the printer 1 described above, when the holding wire 6 swings, the tube holding part 24 crosses, in plan view, the edge 7*c* of the circuit board frame 7 and moves in the movement area S, which extends across the area that overlaps the circuit board frame 7 and the area that does not overlap the circuit board frame 7. In this embodiment described herein a portion of the lower surface of the cover plate 10 covers the tube holding part 24 and is accordingly positioned above the upper end 24*b* of the tube holding part 24. Accordingly, even if the tube holding part 24 moves so as to across the edge 7*c* of the circuit board frame 7 in plan view, the tube holding part 24 does not come into contact with the cover plate 10 and the circuit board frame 7, which is positioned above the cover plate 10.

If the four tubes 12 are displaced upwardly during, for example, the movement of the carriage 3, the tube holding part 24 may be temporarily lifted upwardly by the tube 12. The vertical distance between the circuit board frame 7 and the upper end 24*b* of the tube holding part 24 is small. Accordingly, without a cover plate 10 and in the situation where the tube holding part 27 is lifted upwardly, the upper end 24*b* of the tube holding part 24 may be caught by the edge 7*c* of the circuit board frame 7 when the tube holding part 24 crosses the edge 7*c*. Accordingly, the cover plate 10, as described herein, prevents the upper end 24*b* of the tube holding part 24 from catching the edge 7*c*.

Accordingly, in this embodiment, the cover plate 10 is attached to the lower surface of the circuit board frame 7 so as to cover the entire movement area S of the tube holding part 24. Accordingly, in the vertical direction, the tube holding part 24 directly faces the lower surface of the cover plate 10 and does not directly face the edge 7*c* of the circuit board frame 7 or an edge of the cover plate 10 on the upstream side in the conveying direction. Although the upper end 24*b* of the tube holding part 24 may come into contact with the lower surface of the cover plate 10, the upper end 24*b* is not caught by the edge 7*c* of the circuit board frame 7 or an edge of the cover plate 10 on the upstream side in the conveying direction.

In this embodiment, as described herein, the extruding part 31, protrudes toward the upstream side in the conveying direction beyond other portions positioned in other ranges. Accordingly, the cover plate 10 covers the entire movement area S of the tube holding part 24 in the movement range R2 in plan view and open space is allocated at both ends of the extruding part 31 in the scanning direction. In some embodiments, is also possible to reduce the area of the cover plate 10 by the amount in which the extruding part 31 protrudes. Thus, the cost of the cover plate 10 can be reduced.

Now referring to FIGS. 1-3 and 6, if the printer 1 is clogged with recording paper, for example, the user may insert the user's hand into the interior of the printer 1 from the upstream side in the conveying direction to eliminate the recording paper clog. Accordingly, a circuit board protection part 32 is provided to protect the circuit board 8 from such interference. The circuit board protection part 32 is positioned in range R3 at the upstream end of the cover plate 10 in the conveying direction. The circuit board protection part 32 extends to the upstream side in the conveying direction beyond the edge 7*c* of the circuit board frame 7. Thus, even if the user inserts the user's hand to a portion close to the control circuit board 8, the inserted hand comes into contact with the circuit board protection part 32, which is positioned in front of the control circuit board 8, preventing the hand from coming into contact with the control circuit board 8. Thus, external interference to the control circuit board 8 is blocked.

As shown in FIG. 3, the circuit board protection part 32 positioned at the left end of the movement range R1 of the carriage 3 is positioned downstream of the downstream end of the carriage 3 in the conveying direction. When the carriage 3 reaches the left end of the movement range R1 the carriage 3 is completely exposed without overlapping the circuit board protection part 32. Accordingly, if the printer 1 fails, for example, when the carriage 3 is positioned at the left end of the movement range R1, repair of the carriage 3 and inkjet head 4, replacement of the carriage 3, and other maintenance work can be easily conducted.

In the embodiment shown in FIG. 3, when the carriage 3 reaches the right end of the movement range R1, the carriage 3 is positioned to the right of the cover plate 10 in the scanning direction. In this state, the carriage 3 is not covered by the cover plate 10. Thus, if the carriage 3 requires repair, replacement, or other maintenance work, the carriage 3, positioned at the left end of the movement range R1, is not covered by the cover plate 10 and is therefore accessible for repair. Accordingly, it is possible to place members of the printer 1 above the carriage 3 positioned at the right end of the movement range R1, enabling increased flexibility in a layout.

Since, in this embodiment, the wire holding parts 33 and 35 are attached to the cover plate 10, the cover plate 10 can be used to route the wire 36*a* and FFC 36*b*.

Although a portion, of the four tubes 12, that crosses the edge 7*c* of the circuit board frame 7 moves within the range R4 in the scanning direction, it does not come into contact with the edge 7*c* because the cover plate 10 protrudes in the entire range of the scanning direction beyond the edge 7*c*, which prevents the four tubes 12 from being damaged. The four tubes 12 may come into contact with an edge of the cover plate 10 on the upstream side in the conveying direction. Since the cover plate 10 is made of a synthetic resin, however, even if the tubes 12 come into contact with an edge of the cover plate 10 on the upstream side in the conveying direction, the four tubes 12 are not likely to be damaged as compared to a situation in which the tubes 12 come into contact with the edge 7*c* of the circuit board frame 7.

Next, variations in which various modifications have been added to the embodiment described above will be described. Descriptions of the same structures as in the embodiment described above will be omitted.

In the embodiment described above, the cover plate 10 has not covered the carriage 3 positioned at the left end of the movement range R1 in plan view, but this is not a limitation. In some embodiments, the circuit board protection part 32 may protrude toward the upstream side in the conveying direction by an amount more than in the embodiment described above, such that the cover plate 10 may cover the carriage 3 positioned at the left end of the movement range R1 in plan view. In such embodiments, when the carriage 3 reaches the right end of the movement range R1, the carriage 3 is still positioned to the right of the cover plate 10 in the scanning direction. The entire carriage 3 is thereby exposed without being covered by the cover plate 10. Accordingly, repair of the carriage 3 and inkjet head 4, replacement of the carriage 3, and other maintenance work can be easily conducted.

In the embodiment described above, the wire holding parts 33 and 35 have been attached to the cover plate 10, but this is not a limitation. Wire holding parts may not be attached to the cover plate 10.

In the embodiment described above the extruding part 31 protrudes toward the upstream side in the conveying direction beyond other portions positioned in other ranges, but this is not a limitation. For example, the entire upstream end of the cover plate 10 in the conveying direction may protrude toward the upstream side in the conveying direction substantially by the same amount by which the extruding part 31 protrudes.

In the embodiment described above, the circuit board protection part 32 is attached to the cover plate 10, however, the circuit board protection part 32 may not be attached. That is, at the upstream end of the cover plate 10 in the conveying direction, a portion positioned in the range R3, in which the control circuit board 8 is placed, may be positioned downstream of the edge 7*c* of the circuit board frame 7 in the conveying direction.

In the embodiment described above, the upstream end of the cover plate 10 in the conveying direction protrudes toward the upstream side in the conveying direction beyond the edge 7*c* of the circuit board frame 7 over the entire range R4, in which the tubes 12 cross, however, this is not a limitation. For example, at the upstream end of the cover plate 10 in the conveying direction, a portion positioned in the range R4, in which the tubes 12 cross the edge 7*c* of the circuit board frame 7, but outside the movement range R2 of the tube holding part 24 may be positioned downstream of the edge 7*c* of the circuit board frame 7 in the conveying direction.

Figure 7:
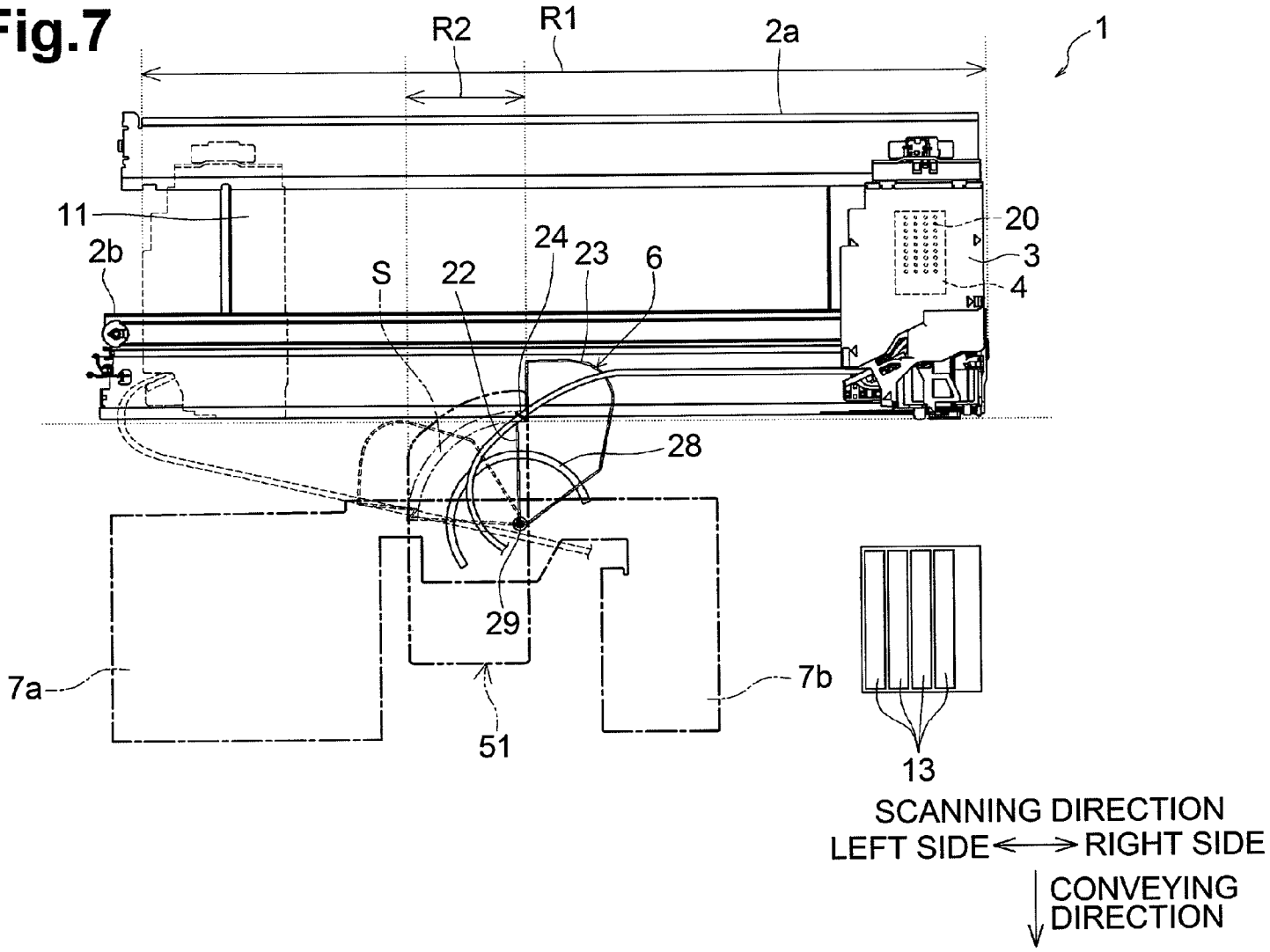
FIG. 7 illustrates a schematic block diagram of an alternative embodiment of a printer structure.

In the embodiment described above, the cover plate 10 has extended in the scanning direction substantially within the same range as the circuit board frame 7, but this is not a limitation. FIG. 7 illustrates a schematic block diagram of an alternative embodiment of a printer structure. In the embodiment shown, a cover plate 51 is provided only within the movement range R2 of the tube holding part 24. At the edge of the cover plate 51 on the upstream side in the conveying direction, both ends of the cover plate 51 have a curved surface, so they are smoothly connected to the right-side edge and left-side edge in the scanning direction.

Even in this case, if the cover plate 51 protrudes toward the upstream side in the conveying direction substantially by the same amount by which the extruding part 31 (see FIG. 3) protrudes, it is possible to prevent the upper end 24*b* of the tube holding part 24 from being caught by the edge 7*c* of the circuit board frame 7 or an edge of the cover plate 51. In a range in which it is possible to prevent the upper end 24*b* of the tube holding part 24 from being caught by the edge 7*c* of the circuit board frame 7 or an edge of the cover plate 51, the cover plate 51 can be minimized in the scanning direction. In such an embodiment, the four tubes 12 cross the upstream edge of the cover plate 51 in the conveying direction and, depending on the position of the carriage 3, the right-side edge or left-side edge in the scanning direction. However, as described in the first variation, however, the upstream edge of the cover plate 51 in the conveying direction is smoothly linked to the right-side edge and left-side edge, so to the tubes 12 are prevented from being caught by an edge of the cover plate 51.

Figure 8:
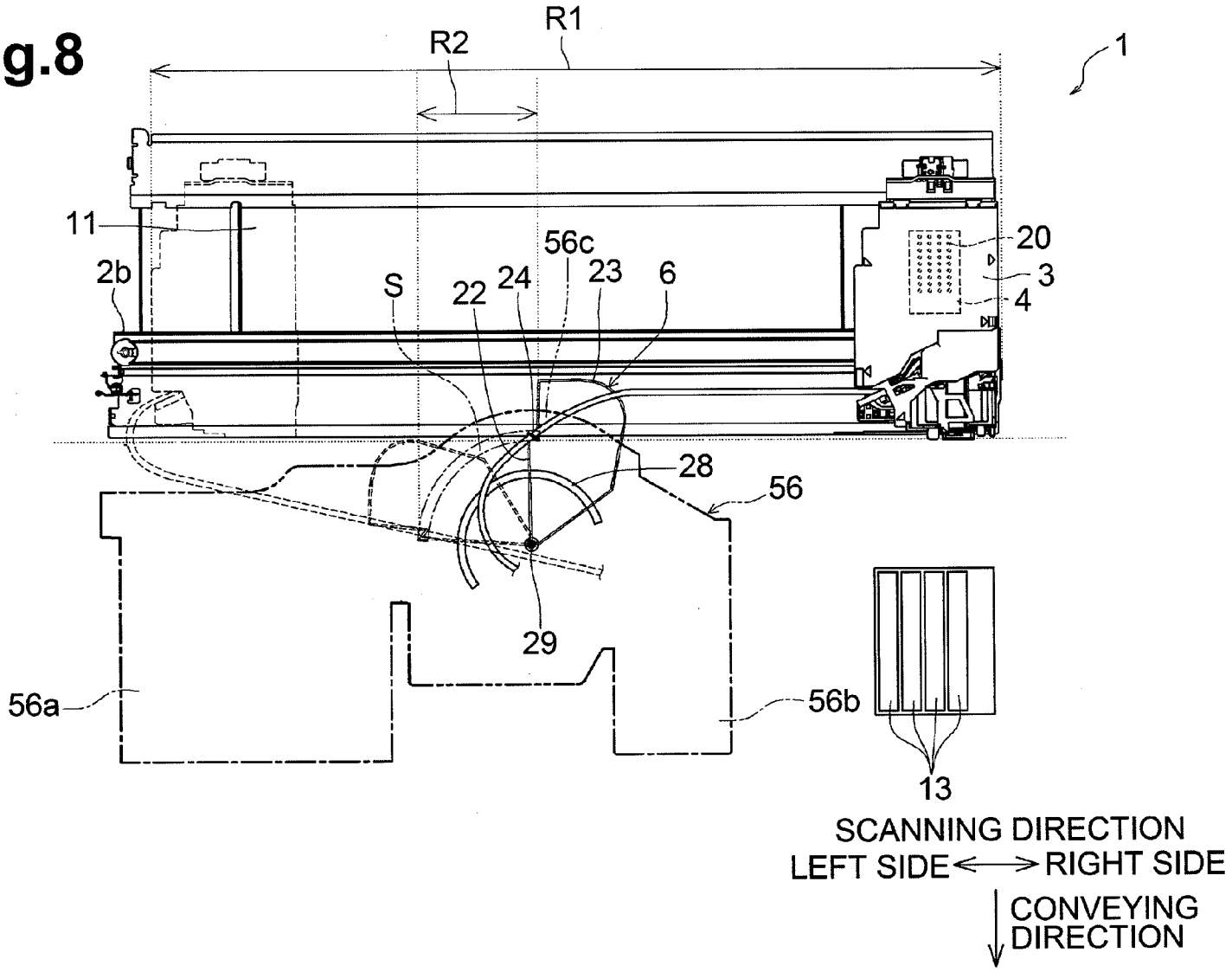
FIG. 8 illustrates a schematic block diagram of an alternative embodiment of a printer structure.

In the embodiment described above, the cover plate 10 has been secured to the lower surface of the circuit board frame 7, but this is not a limitation. Now referring to FIG. 8, another embodiment, a structural member 56 is provided instead of the circuit board frame 7 and cover plate 10. In such an embodiment, the circuit board frame 56 extends in the scanning direction substantially by the same amount by which the circuit board frame 7 and cover plate 10 extend. Both ends of the circuit board frame 56 in the scanning direction extend toward the downstream side in the conveying direction beyond a portion between these ends, forming circuit board mounting parts 56*a* and 56*b*. The control circuit board 8 is mounted on the upper surface of the circuit board mounting part 56*a*, and the circuit board 9 is mounted on the upper surface of the circuit board mounting part 56*b*.

At the upstream end of the circuit board frame 56 in the conveying direction, a portion positioned in a partial range including the movement range R2 of the tube holding part 24 in the scanning direction is referred to as a cover 56*c*, which protrudes toward the upstream side in the conveying direction beyond other portions positioned in other ranges. The cover 56*c* protrudes toward the upstream side in the conveying direction beyond the movement area S. Thus, part of the movement area S of the tube holding part 24 overlaps the cover 56*c* in plan view, and the rest of the movement area S overlaps a portion of the circuit board frame 56 other than the cover 56*c*.

In this case, the tube holding part 24, which moves in the movement area S, overlaps the cover 56*c* of the circuit board frame 56 and any portion other than the cover 56*c* in plan view. Therefore, the tube holding part 24 is prevented from being caught by an edge 56*d* of the circuit board frame 56.

In the above examples, the circuit board frames 7 and 56 on which the control circuit board 8 and circuit board 9 are mounted are disposed above the holding wire 6, however in other embodiments, structural members other than a circuit board frame may be provided above the holding wire 6.

In the embodiment described above, the upper end 24*b* of the tube holding part 24 is closer to the circuit board frame 7 than the tubes 12, however in other embodiments, other the upper end 24*b* is positioned differently. For example, a positional relationship in the vertical direction among the carriage 3 and the holding wire 6 may be different, and the upper end of a portion of the tubes 12, close to the tube holding part 24 may be closer to the circuit board frame 7 than the upper end of the holding wire 6. Alternatively, if the four tubes 12 are formed integrally instead of being separated, for example, a holding wire 6 may hold only a single tube that is below the uppermost tube, so the upper end of the integrated tubes 12 may be closer to the circuit board frame 7 than the upper end of the holding wire 6.

In such an embodiment, the upper end of the tubes 12 are closer to the circuit board frame 7 than the holding wire 6. When the tubes 12 are lifted by holding wire 6, the tubes 12 are closer to the circuit board frame 7. Accordingly, if the cover plate 10 is not provided, the upper end of the tubes 12 may be caught by the edge 7*c* of the circuit board frame 7. In this embodiment, however, the cover plate 10 is placed on the lower surface of the circuit board frame 7, so the upper end of the tubes 12 are prevented from being caught by the edge 7*c* of the circuit board frame 7.

In the embodiment described above, the circuit board frame 7 is positioned above the main body frame 5 to which the holding wire 6 is attached. The holding wire 6 is structured so that the tube holding part 24 upwardly protrudes beyond other portions. In other embodiments, the positional relationship in the vertical direction between the main body frame 5 to which the holding wire 6 is attached and the circuit board frame 7 on which the control circuit board 8 and circuit board 9 are mounted may be reversed. That is, the main body frame 5 may be placed at a position higher than in the embodiment described above and the circuit board frame 7 may be placed below the main body frame 5. In this case, the holding wire 6 is attached to the lower surface of the main body frame 5 and the tube holding part 24 downwardly extends beyond other portions. The control circuit board 8 is mounted on the lower surface of the circuit board mounting part 7*a*, and the circuit board 9 is mounted on the lower surface of the circuit board mounting part 7*b*. Even in this embodiment, if the cover plate 10 is placed on the upper surface of the circuit board frame 7, that is, between the holding wire 6 and the circuit board frame 7, it is possible to prevent the lower end of the tube holding part 24 from being caught by the edge 7*c* of the circuit board frame 7.

The holding wire 6 is not limited to a wire having the curved part 23 and the straight part 22 on which tube holding part 24 is provided. For example, the holding wire 6 may lack the curved part 23. The holding member that holds the tubes 12 may not be a member formed by bending a wire made of a metal material.

In the embodiment described above, the holding wire 6 holds the tubes 12, however in other embodiments, the holding wire 6 holds other types of flexible members of the printer 1. The inkjet head 4 mounted in the carriage 3 may be electrically connected to the main body of the printer 1 through, for example, an FFC 15. In such an embodiment, the holding wire 6 may hold the FFC 15 and a film-like shielding member for suppressing noise generated when the FFC moves. Alternatively, if there is no need to use the tubes 12, which interconnect the inkjet head 4 and four ink cartridges 13, because, for example, the ink cartridges 13 are placed on the carriage 3, the holding wire 6 may hold only the FFC 15 or only the FFC 15 and shielding member. Furthermore, the holding wire 6 may hold a flexible elongated member, other than the tubes 12 and FFC 15 that are connected to the inkjet head 4. In such alternative embodiments, the holding wire 6 supports the FFC 15 in positions analogous to those described above relative to tubes 12, in connection with FIGS. 1-8.

Even in these cases, as in the embodiment described above, since the cover plate 10 is placed between the circuit board frame 7 and a portion of the holding wire 6, that holds the elongated member, it is possible to prevent the upper end of the portion of the holding wire 6 that holds the elongated member or the upper end of a portion of the elongated member that is held by the holding wire 6 from being caught by the edge 7*c* of the circuit board frame 7.

In the embodiment described above, the edge 7*c* of the circuit board frame 7 linearly extends in the scanning direction, however in other embodiments, the edge may extend in the scanning direction so as to be curved.

In the embodiment described above, the scanning direction and conveying direction have been parallel to a horizontal plane, however in other embodiments, the scanning direction and the conveying direction may be parallel to a prescribed plane other than a horizontal plane, such as, for example, a vertical plane and a plane inclined relative to a horizontal plane.

The examples described in the present disclosure have been applied to an inkjet printer that that ejects ink to make a printout, however the aspects of the present disclosure may be applied to a liquid ejection apparatus other than an inkjet printer that ejects a non-ink liquid.

What is claimed is:

1. A liquid ejection apparatus comprising:

a carriage configured to reciprocate in a scanning direction;

a liquid ejection head mounted in the carriage;

a flexible member connected to the liquid ejection head;

a hold member configured to hold the flexible member;

a structural member arranged along a virtual plane, the virtual plane parallel to a virtual line extending in the scanning direction, the structural member arranged to be offset in a direction parallel to the virtual plane and perpendicular to the scanning direction from the carriage, the structural member including an edge portion, a first side proximate the flexible member and the hold member in a direction perpendicular to the virtual plane, and a second side opposite to the first side in the direction perpendicular to the virtual plane;

a control circuit board mounted on the second side of the structural member;

wherein one of the hold member and the flexible member comprises a proximal portion nearest to the first side of the structural member in the direction perpendicular to the virtual plane;

the proximal portion is movable between first and second positions as the carriage reciprocates in the scanning direction, wherein in the first position, the structural member overlaps the proximal portion in a direction perpendicular to the virtual plane and in the second position the structural member does not overlap the proximal portion in the direction perpendicular to the virtual plane; and a cover plate provided between the first side of the structural member and the proximal portion, wherein at least a portion of the cover plate overlaps the edge portion in the direction perpendicular to the virtual plane, wherein the cover plate overlaps the proximal portion in the direction perpendicular to the virtual plane in the first and second positions, and wherein a part of the cover plate is nearer to the carriage in the direction parallel to the virtual plane and perpendicular to the scanning direction than the structural member.

2. The liquid ejection apparatus according to claim 1, wherein during movement between the first and second positions, the proximal portion overlaps the edge portion in the direction perpendicular to the virtual plane.

3. The liquid ejection apparatus according to claim 1, further comprising:

a movement range extending along the scanning direction, the movement range having a first range and a second range;

the carriage configured to reciprocate in the movement range;

the edge portion extending along the scanning direction;

the proximal portion configured to move in the first range;

the cover plate further comprising:

a first portion extending along the first range, the first portion having an extrusion portion protruding in a direction perpendicular to the scanning direction; and a second portion extending along the second range; and wherein the first portion overlaps the proximal portion in the first position and the second position in the direction perpendicular to the virtual plane.

4. The liquid ejection apparatus according to claim 3, further comprising:

the movement range having a third range which is different from the first range and the second range, wherein the control circuit board is arranged in the third range; and the cover plate comprises a protection portion for protecting the control circuit board, the protection portion extending along the scanning direction in the third range.

5. The liquid ejection apparatus according to claim 4, further comprising:

a wire connected to the control circuit board; and a wire hold portion configured to hold the wire.

6. The liquid ejection apparatus according to claim 5, wherein the wire hold portion further comprises:

a plurality of wire hook members configured to hook the wire, each of the plurality of wire hook members arranged in an interval apart from each other in the scanning direction.

7. The liquid ejection apparatus according to claim 4, wherein the cover plate does not overlap the carriage in the direction perpendicular to the virtual plane when the carriage is offset in the scanning direction from the first portion.

8. The liquid ejection apparatus according to claim 7, wherein the cover plate does not overlap the carriage in the direction perpendicular to the virtual plane when carriage reciprocates in the third range.

9. The liquid ejection apparatus according to claim 3, wherein:

the proximal portion is configured to move in a part of the movement range in the scanning direction; and the cover plate is positioned in the part of the movement range.

10. The liquid ejection apparatus according to claim 1, wherein, in at least one position of the carriage along the movement range, the cover plate overlaps the flexible member in the direction perpendicular to the virtual plane.

11. The liquid ejection apparatus according to claim 1, wherein the hold member comprises an axis portion extending in the direction perpendicular to the virtual plane, and a grip portion operably connected to the axis portion, the grip portion configured to move about the axis portion and to grip the flexible member, and the cover plate comprises an edge having a curved shape.

12. The liquid ejection apparatus according to claim 11, wherein the grip portion comprises the proximal portion.

13. The liquid ejection apparatus according to claim 1, further comprising:

a control circuit board mounted on the structural member;

wherein the flexible member includes a flexible wiring board electrically connecting the circuit card and the liquid ejection head.

14. The liquid ejection apparatus according to claim 1, wherein:

the flexible member includes a tube fluidly connected to the liquid ejection head and configured for fluid connection to a cartridge, wherein the tube is configured to supply the liquid to the liquid ejection head from the cartridge.

15. The liquid ejection apparatus according to claim 1, wherein a part of the hold member does not overlap the cover plate in the direction perpendicular to the virtual plane when the proximal portion is positioned in the second position.

16. The liquid ejection apparatus according to claim 1:

wherein the cover plate further comprises a curved edge extending in a direction perpendicular to the scanning direction; and wherein, between the first position and the second position the hold member follows a curved path that generally follows the curved edge of the cover plate.

17. A printer comprising:

a cartridge holding a liquid; and a liquid ejection apparatus, the liquid ejection apparatus including:

a carriage configured to reciprocate in a scanning direction;

a liquid ejection head mounted in the carriage for fluid connection to the cartridge;

a flexible member connected to the liquid ejection head;

a hold member configured to hold the flexible member;

a structural member arranged along a virtual plane, the virtual plane parallel to a virtual line extending in the scanning direction, the structural member arranged to be offset in a direction parallel to the virtual plane and perpendicular to the scanning direction from the carriage, the structural member including an edge portion, a first side proximate the flexible member and the hold member in a direction perpendicular to the virtual plane, and a second side opposite to the first side in the direction perpendicular to the virtual plane;

a control circuit board mounted on the second side of the structural member;

wherein one of the hold member and the flexible member comprises a proximal portion nearest to the first side of the structural member in the direction perpendicular to the virtual plane;

the proximal portion is movable between first and second positions as the carriage reciprocates in the scanning direction, wherein in the first position, the structural member overlaps the proximal portion in a direction perpendicular to the virtual plane and in the second position the structural member does not overlap the proximal portion in the direction perpendicular to the virtual plane; and a cover plate provided between the first side of the structural member and the proximal portion, wherein at least a portion of the cover plate overlaps the edge portion in the direction perpendicular to the virtual plane, wherein the cover plate overlaps the proximal portion in the direction perpendicular to the virtual plane in the first and second positions, and wherein a part of the cover plate is nearer to the carriage in the direction parallel to the virtual plane and perpendicular to the scanning direction than the structural member.

18. The printer according to claim 17, wherein the liquid ejection head is fluidly connected to the cartridge.

* * * * *